United States Patent [19]

Colombo

[11] 4,125,953

[45] Nov. 21, 1978

[54] STEAM IRON

[75] Inventor: Ambrogio Colombo, Monza, Italy

[73] Assignee: Fibelco N.V., Willemstad, Netherlands

[21] Appl. No.: 815,682

[22] Filed: Jul. 14, 1977

[30] Foreign Application Priority Data

Jul. 15, 1976 [IT] Italy ..... 25333 A/76

[51] Int. Cl.[2] ..... D06F 75/06; D06F 75/18

[52] U.S. Cl. ..... 38/77.7; 38/77.2; 38/77.83

[58] Field of Search ..... 38/77.2, 77.5, 77.7, 38/77.8, 77.81, 77.82, 77.83

[56] References Cited

U.S. PATENT DOCUMENTS

| | | | |
|---|---|---|---|
| 2,337,077 | 12/1943 | Woodman | 38/77.7 |
| 2,499,835 | 3/1950 | Rakos | 38/77.7 |
| 2,588,747 | 3/1952 | Morton | 38/77.83 |
| 2,805,497 | 10/1957 | Gomersall | 38/77.7 |
| 2,853,814 | 9/1958 | Brandler et al. | 38/77.83 |
| 2,883,779 | 4/1959 | Krause et al. | 38/77.2 |

*Primary Examiner*—Patrick D. Lawson

*Attorney, Agent, or Firm*—Dressler, Goldsmith, Clement, Gordon & Shore, Ltd.

[57] ABSTRACT

A steam iron is provided in which the water supply to the steam generating chamber is variable, depending on the temperature, and scraping means operated by the steam which is generated are provided in the steam generating chamber for removing any scale which is formed.

7 Claims, 8 Drawing Figures fig-1
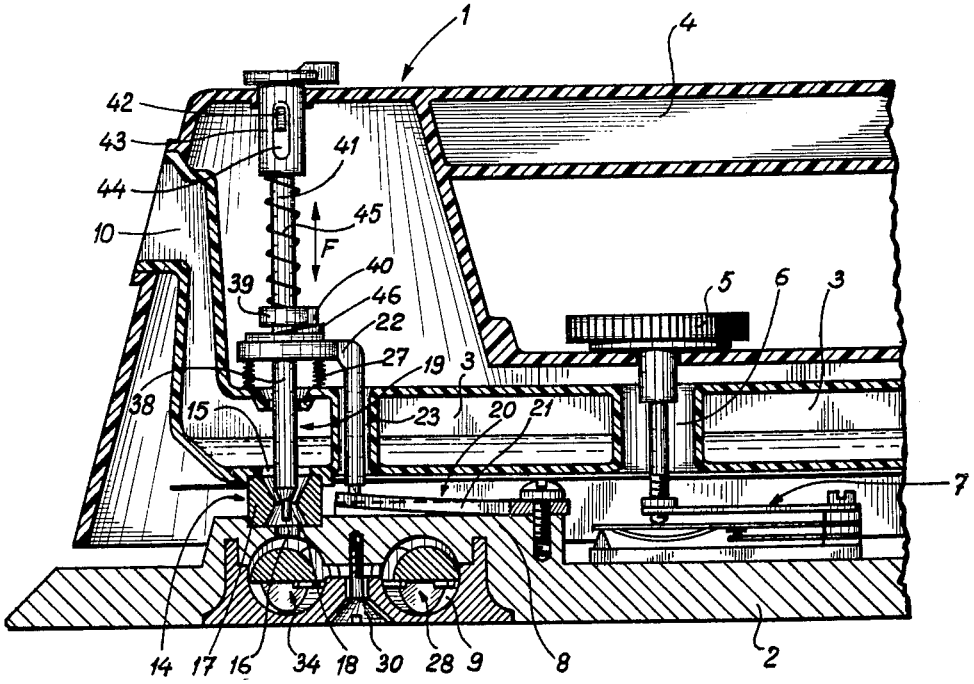
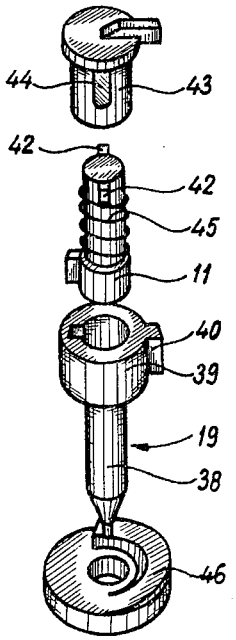
fig-1a

STEAM IRON

The present invention relates to a steam iron in which the steam supplied by it is variable dependent on the operation temperature. The steam generating space of the iron is provided with a scraping off means for removing lime deposits or "scale" and with a light-signal for indicating a minimum water level.

BACKGROUND OF THE INVENTION

Various types of steam irons are known mainly consisting of a water reservoir which by means of a closing valve is connected to a steam generating space formed by a recess in the heating plate. The steam generating space is connected to the exterior by means of a number of small openings provided in the heating plate.

It is known that the quantity of steam which has to be supplied to the material to be ironed varies according to the kind of material, the average of it being equal to about 20% of the total amount of liquid which can be absorbed by the material. To obtain a good ironing operation furthermore it is necessary that this takes place at a previously selected temperature which varies according to the kind of material.

In order to obtain the temperature required for a certain kind of material the known irons are provided with a thermostatic device which controls the temperature of the heating plate (normally lying between 100° and 220° C.) and is maintaining this at the pre-selected level.

THE PRIOR ART

This type of irons, however, has a great disadvantage resulting from the fact that the quantity of steam supplied by it remains constant irrespective of the operation temperature. The valve present between the water reservoir and the steam generating space is a valve with two positions corresponding with the fully opened and with the fully closed position resp. of the supply passage for the water of the reservoir to the steam generating space. In this way, at the lowest working temperature, viz. somewhat above 100° C., steam is generated with an excessive moisture contact, whereas at the maximum temperature, viz. about 220° C., steam is obtained with almost no moisture. In each case both mentioned circumstances appear to be unsuitable for obtaining a good ironing operation.

A further disadvantage of the known type of irons is that the generated steam, in particular at the outlet openings to the material, has a decreased pressure which is much lower than at the originating of the steam. The evaporation of the water coming out of the reservoir normally takes place in a central zone of the heating plate, from which the generated steam is moving in the direction of the openings which are peripherically provided in said plate. During this passage the steam will not met any obstacle which will oppose the expansion and therefore the pressure will decrease. Consequently the outflowing steam penetrates into the material to be ironed to a less degree and is mainly distributed over the outersurface of it. So it appears that the conditions for the moistening of the material are further reduced which makes the obtaining of a good ironing outcome more difficult.

Another disadvantage of the known type of irons, being a direct consequence of the just mentioned disadvantage, results from the originating of scale both in the steam generating space and in the steam outlet openings. The steam generating space is difficult to reach by the user so that removing scale in practice appears to be impossible. It is also difficult to remove this scale via the outlet openings because these openings, as known, have a very small diameter.

Again another disadvantage of the known type of irons results from the fact that it is difficult for the user to determine exactly the water level in the reservoir. Some types of irons exist being provided with means by which the water level can be read but besides these irons having a complicated construction they do not give an accurate indication of the exact amount of water in the reservoir. So the user will have to estimate this amount of water through experience and it often happens that one continues ironing also when the reservoir contains only very little water.

THE INVENTION

An object of the present invention is to provide a steam iron which makes it possible to eliminate all the above mentioned disadvantages, establishing the most favourable conditions for the realization of a good ironing outcome at each prescribed working temperature and for whatever material.

So the iron objected by the present invention is characterized by the fact that the valve forming the connection between the water reservoir and the steam generating space is connected to thermostatic means controlling the degree of opening of that valve, as well as by the fact that in the steam generating space a scraping means is present for removing the scale within said space.

An advantage of the steam iron according to the present invention consists in the fact that the water reservoir is connected to the steam generating space only when the heating plate has reached the temperature required for the evaporation of the water. In this way water will enter the steam generating space only when the conditions for evaporation are established.

A second advantage of the iron according to the present invention consists in the fact that the quantity of water which is let into the steam generating space is variable according to the temperature, in which way steam is obtained with a constant moisture content at each working temperature. At a minimum working temperature a minimum quantity of water will enter into the steam generating space and at a maximum temperature a maximum quantity of water. At intermediate temperatures also intermediate amounts of water are obtained, which are increasing at rising temperature.

A further advantage of the steam iron according to the present invention consists in the fact that the steam generating space is provided with means for removing scale, if any, which can form itself on the inner surface of it. This means is directly driven by the steam which is generated in the steam generating space and so the user needs not to pay special attention to it.

An other advantage of the relating iron consists in the fact that the steam generating space is easely accessible for periodical maintenance without special auxiliary means or dependence on skilled labourers.

Still another advantage of the present iron consists in the special construction of the outlet tube for the steam from said space, so that steam is obtained having a high pessure when leaving the iron. On the one side this pressure is of such a character that scale in the outlet tube is removed and on the other side the steam penetrates well into the material.

Still an advantage of the relating iron is that it is provided with an indication light being connected to interrupters which are situated in the water reservoir and which with the greatest accuracy can determine the moment that the level on the water in the reservoir has fallen to such a minimum that the reservoir has to be filled again.

This and still other advantages and features of the steam iron according the present invention will appear more clearly from the following detailed description of a non-limiting embodiment by means of the annexed figures, in which:

BRIEF DESCRIPTION OF DRAWINGS

FIG. 1 is a cross sectional view of the iron according to the present invention, and FIG. 1*a* shows the components of the valve pin.

Figure 2:
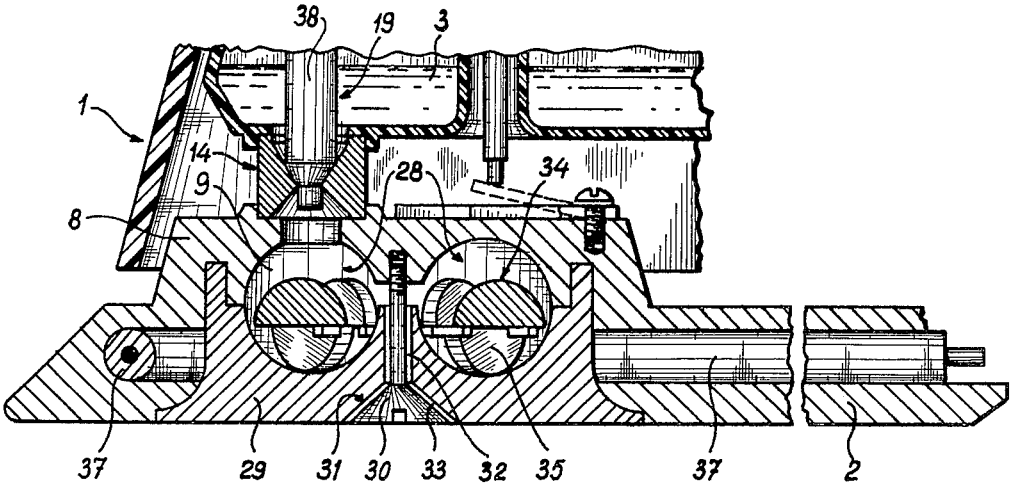
FIG. 2 is a cross sectional view, on an enlarged scale, of the steam generating space and of the means for controlling the opening and closing of the inlet valve for the water.

According to FIG. 1 the steam iron according to the present invention consists of a body 1 which in a manner known per se is connected to a heating plate 2, in which a water reservoir is situated. Above the reservoir 3 the body 1 is provided with a handle 4. An adjusting screw 5 is extending from the body 1 below the handle 4, which screw, via an opening 6, acts upon a thermostat 7, which is known per se and therefore is not extensively described, for controlling the working temperature of the heating plate 2. In the last mentioned heating plate a steam generating space 9 is formed by a recess in a portion 8 with a greater thickness, which space will be described below in detail.

Figure 4:
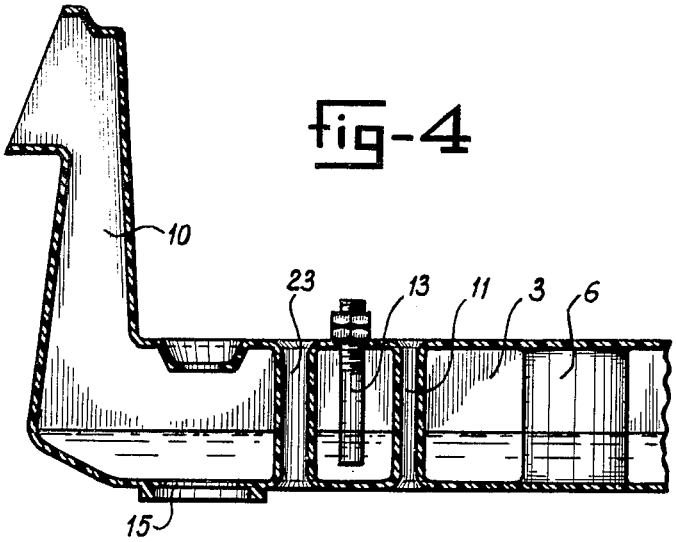
FIG. 4 is a cross sectional view of the water reservoir.
Figure 5:
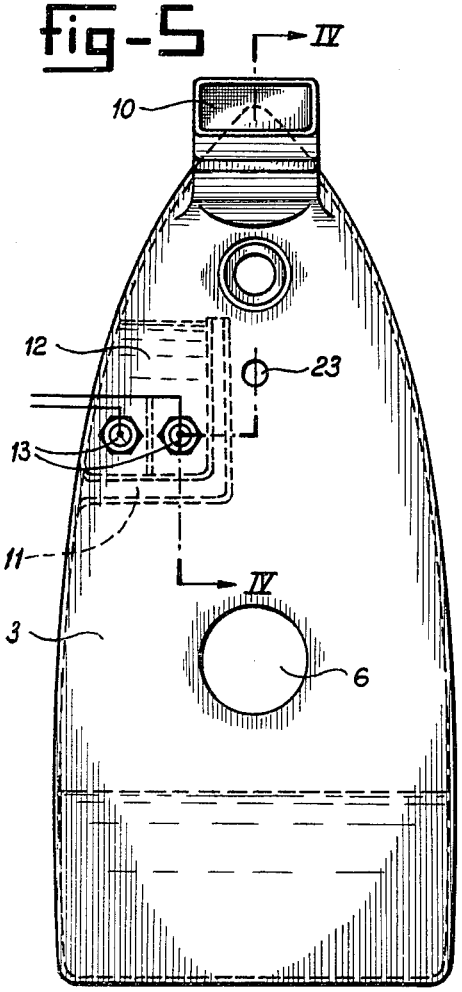
FIG. 5 is a top view of said reservoir.
Figure 6:
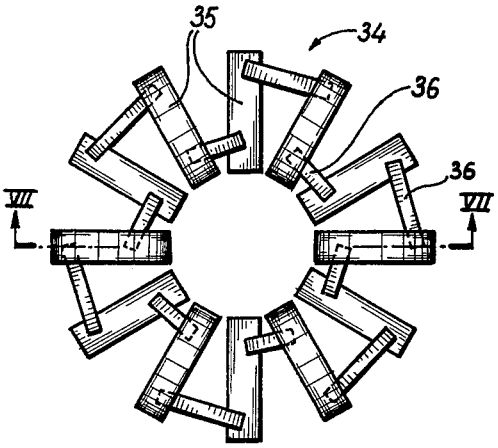
FIG. 6 is a top view of the scraping means provided in the steam generating space.
Figure 7:
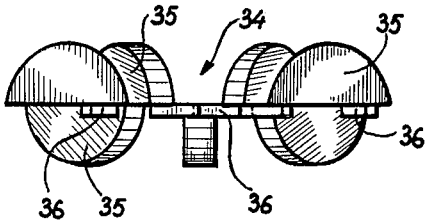
FIG. 7 is a cross sectional view of said scraping means.

In the FIGS. 1, 4 and 5 the reservoir 3 of the steam iron according to the present invention consists of a mainly parallelepiped shaped body, which tapers at one end and at that place is provided with an inlet tube 10 for the feed water. Also near said end a narrowed portion 11 is provided in the reservoir 3 mainly in the shape of an L and confining a chamber 12 for observing the water level within the reservoir. When the water is supplied through the tube 10 it will fill the reservoir 3 and reach a level equal to the level in the chamber 12. The latter can only get filled with water when the remaining part of the reservoir 3 is full at the moment of the replenishing. In said chamber 12 water is present in an amount which decreases according to the amount of water which runs out of the reservoir to be transformed into steam. So the decreasing water level within the chamber 12 is connected with the water consumption itself, that means the amount of water which is removed from the reservoir to be transformed into steam. When the iron is placed on a supporting surface in vertical position the narrowed portion 11 appears to be able to hold a certain amount of water, dependent on the total amount of water in the reservoir 3.

In the FIGS. 4 and 5 it is shown that a pair of studs 13 is positioned within the chamber 12, which are connected to a feed circuit and to a signal lamp. The signalizing circit is known per se and is executed such that the signal lamp remains burning when when both studs 13 are partly positioned in the water. In view of the fact that the lenght of the studs 13 is less than the height of the reservoir 3, they are not positioned in the water when this is dropped to a minimum level, in consequence of which the signal lamp goes out. A feature of the steam iron according to the present invention is the fact that, when the water level is only slightly higher than the minimum the studs 13 will alternately be immersed into the present amount of water in consequence of the movement of the iron during ironing, such that the signal lamp will go on and out at intervals. By this the user is warned that the water has to be replenished again.

In FIG. 1 the reservoir 3 is connected to the steam generating space 9 by means of a cut off value 14 being situated between an outlet opening 15 of the reservoir 3 and an inlet opening 16 of the steam generating space 9. The cut off valve 14 consists of a mainly cylindrical valve body 17 with an internal converging-diverging cross section defining a passage 18 in which a closing member 19 is movable consisting of a pin with a conical end joining the corresponding convergent part of the valve body 17. The pin 19 is moving in such a way in the direction of the arrow F that its conical end, which is moving in the passage 18, is able to vary the flow of water from the reservoir 3 to the steam generating space 9.

In FIG. 1, the pin 19 consists of a metal element 38 with a conical end. A sleeve 39 with a projection 40 is connected to the other end of the pin. The end of a second element 41 is closely fitted into the sleeve 39. The other end of the last mentioned element is provided with two opposite aligned projections 42 by means of which the element is not influenced by rotatable movements within a handle 43. The non-influencing by the rotatable movements is caused by inserting the projections 42 into grooves 44 of the handle 43. On the second element 41 a spring 45 is provided. The movement of the pin 19 takes place by means of a schematically shown thermostatic device 20, normally consisting of a bimetallic element 21 which exactly corresponds with the element of the thermostat 7 of the iron. The end of the bimetallic element 21 engages an L-shaped backing element 22 with one side leg running through an opening 23 in the reservoir 3 and a second side leg having an opening in which the metal element 38 is inserted. A cylindrical shaped cam 40 with adjustable height is connected to the backing element 22 coaxially with the element 38. The pin 19 may take up two positions by the rotatable movement of the handle 43. In the first position the projection 40 is positioned on the lowest point of the cam 46 such that the element 22 remains upwards. This position corresponds with ironing without steam. In the second position the projection 40 is moved to the highest point of the cam 46 by which the element may come in the neighbourhood of the thermostatic device 20. This position corresponds with the ironing with steam so far that deformations of the bimetallic element 21 bring about a displacement of the element 22 and in consequence of this an increasing rising movement of the element.

In FIG. 1 a pair of springs 27 is provided between the L-shaped element 22 and the surface of the reservoir 3 lying below it for a balanced movement of the L-shaped element 22 such that the element is moved in a rectilinear direction perpendicular to the longitudinal middle axis of the reservoir 3.

In FIG. 1 and in particular in FIG. 2 the steam generating space 9 consists of a mainly annular cavity 28, at one side being defined by a semi-circular shaped cavity formed by a recess in a part 8 with a greater thickness than that of the heating plate 2, and at the other side defined by a corresponding semi-circular cavity formed as a recess in a closing member or back wall 29 which is inserted in the heating plate 2 and connected to it by means of a screw 30 which is threaded into the part 8 with greater thickness of the heating plate 2.

Figure 3:
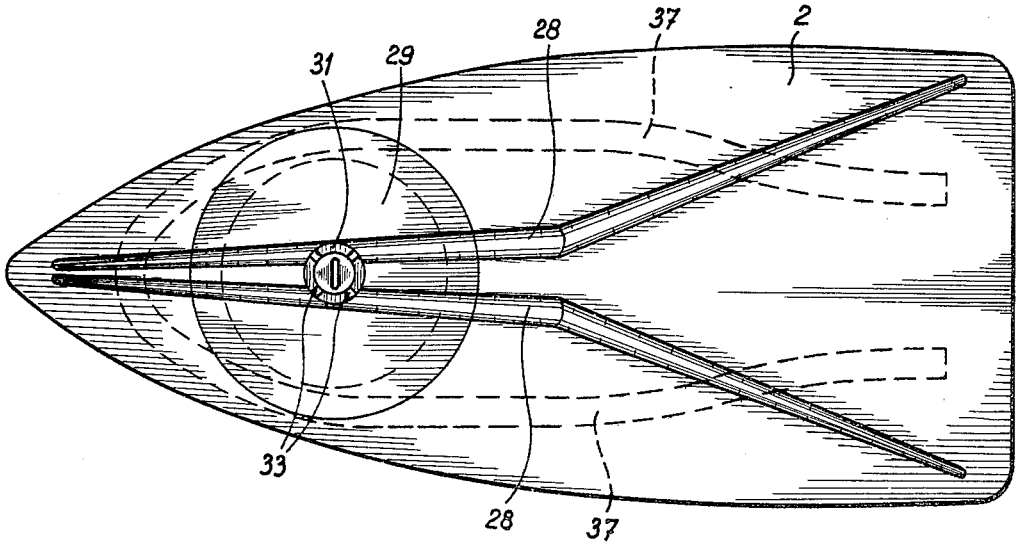
FIG. 3 is a plan view of the lower surface of the heating plate.

As particular appears from FIG. 3 the closing member or back wall 29 normally has a circular shape and is provided with a cavity 31 in its center in which the head of the screw 30 rests and which is connected to an opening 32 for the passage of the screw 30. In the cavity 31 radially extending grooves are provided (from which four are shown in FIG. 3) for the removing of the steam formed in the steam generating space 9. Besides this the cross section of the screw 30 is smaller than that of the opening 32 such that the steam may move from the steam generating space 9 to the grooves 33.

The above described embodiment of the steam generating space 9 allows the obtaining of steam which, when leaving the space, has a high pressure and guarantees both that the steam penetrates well into the material and that the outlet passages are cleaned continuously and efficacious. It is obvious that the steam, generated within the steam generating space 9, cannot expand immediately as is the case with the steam generating spaces of the known type of irons, such that the pressure is not decreased. On the contrary the steam is pressed to the central part of the steam generating space 9 in which it is concentrated and subsequently obtains a particulary high pressure in accordance with the outlet opening 32. By this the steam is given a cleaning action both in the interior of the steam generating space 9 and in the outlet passage 32 and the grooves 33.

In the FIGS. 1, 2, 6 and 7 scraping means is provided inside the steam generating space 9 for removing scale, if any, from the innerwalls of said space. This scraping means (in detail separately shown in the FIGS. 6 and 7) consists of a mainly toroidal element 34 the shape of which corresponds with that of the annular cavity 28 however with somewhat smaller dimensions such that the toroidal element 34 may move itself within the space 9. In particular the toroidal element 34 consists of a number of semi-cylindrically shaped segments 35 which are alternately positioned above and below the transversal plane of the element 34 and are connected with each other by connecting segments 36 integral with the semi-cylindrically shaped segments 35. The alternating positioning of the semi-cylindrically shaped segments 35 accomplishes and facilitates the flow of the steam through the toroidal element 34 by which this will be going to rotate.

According to another embodiment it is advantageous that the means for removing scale, provided in the interior of the steam generating space 9, consists of a number of small balls which in the interior of the space 9 are set in motion by the generated steam.

Besides this the movement of the above mentioned scraper means is partly caused by the movement of the user himself during ironing, such that the inner walls of the space 9 are still better cleaned.

According to the FIGS. 2 and 3 the steam iron according to the present invention is provided with a heating resistance 37 running in longitudinal direction over the heating plate 2 and totally enclosing the steam generating space 9 (FIG. 3) completely.

In FIG. 3 that side of the heating plate 2 which contacts the material to be ironed is provided with two mainly longitudinal grooves 28 diverging in the direction of the rear end of the iron to facilitate the distribution of the steam, flowing out of the steam generating space 9, over the entire surface of the heating plate 2.

Concerning finally the thermostatic element controlling the movement of the pin 19 of the valve 14 it may be remarked that the embodiment is such that said bimetallic element is the same element as that of the thermostat 7, in consequence of which the construction of the iron is simplified.

Alternative embodiments and/or modifications in the iron according to the present invention are possible without falling outside the scope of the invention.

I claim:

1. A steam iron comprising a heating plate including a steam generating chamber, a reservoir for water, said steam generating chamber being spaced from and connected to said water reservoir, valve means regulating the connection between said chamber and said reservoir, thermostatic means for controlling the degree of opening of said valve means, said steam generating chamber having an annular shape with at least one steam discharge outlet at the center thereof, scraping means contained in said annular chamber and adapted to contact the inner walls of said annular chamber and to be moved by the steam which is generated for removing scale deposited within said annular chamber.

2. A steam iron according to claim 1 in which the thermostatic means consists of a bimetallic element, a backing element, and a pin, the end of said pin being movable within the connection between said reservoir and said chamber.

3. A steam iron according to claim 1 in which said steam generating chamber comprises a semi-circular cavity formed by a recess in the heating plate at one side thereof, and by a second semi-circular cavity formed as a recess in a member connected to said heating plate at the other side thereof.

4. A steam iron according to claim 3 in which said member is connected to said heating plate by means of a locking screw, the head of which rests in a cavity in the member, and the shaft of which is inserted in an opening of the member having a cross-section which is larger than that of the screw.

5. A steam iron according to claim 4 in which said cavity includes radially extending grooves for removing the steam from said heating plate.

6. A steam iron according to claim 1 in which said scraping means consists of a toroidal member having a number of interconnected semi-cylindrically shaped segments.

7. A steam iron according to claim 1 in which said scraping means consists of a number of small balls disposed within said chamber.

* * * * *